US007986590B2

(12) United States Patent
Hansen

(10) Patent No.: US 7,986,590 B2
(45) Date of Patent: Jul. 26, 2011

(54) CALENDAR APPARATUS

(76) Inventor: Angela Hansen, Dubuque, IA (US)

( * ) Notice: Subject to any disclaimer, the term of this patent is extended or adjusted under 35 U.S.C. 154(b) by 534 days.

(21) Appl. No.: 12/110,835

(22) Filed: Apr. 28, 2008

(65) Prior Publication Data

US 2009/0268564 A1 Oct. 29, 2009

(51) Int. Cl.

| | |
|---|---|
| ***G04B 47/00*** | (2006.01) |
| ***G04B 19/24*** | (2006.01) |
| ***G04C 21/00*** | (2006.01) |
| ***G04C 23/02*** | (2006.01) |
| ***G09D 3/02*** | (2006.01) |

(52) U.S. Cl. ..... 368/10; 368/29; 368/73; 368/88; 368/278; 40/122

(58) Field of Classification Search ..... 368/10, 368/28–30, 41, 63, 72–74, 250, 88, 76, 278; 40/107, 122; 705/8, 9

See application file for complete search history.

(56) References Cited

U.S. PATENT DOCUMENTS

| | | | | | |
|---|---|---|---|---|---|
| 2,845,732 | A * | 8/1958 | Nichols | 40/726 |
| 2,892,275 | A * | 6/1959 | Woofter | 40/122 |
| 4,276,703 | A * | 7/1981 | Brindley | 40/121 |
| 4,302,752 | A | 11/1981 | Weitzler | |
| 4,708,490 | A * | 11/1987 | Arber | 368/28 |
| 5,199,009 | A * | 3/1993 | Svast | 368/240 |
| 5,708,627 | A | 1/1998 | Gormley | |
| 5,754,629 | A * | 5/1998 | Kunimori et al. | 379/88.13 |
| 5,999,492 | A * | 12/1999 | Teixeira | 368/10 |
| 6,069,848 | A * | 5/2000 | McDonald et al. | 368/107 |
| 6,574,894 | B1 * | 6/2003 | Hamilton | 40/107 |
| 7,200,071 | B2 * | 4/2007 | Brophy | 368/28 |
| 7,480,212 | B1 * | 1/2009 | DuBreuil | 368/30 |
| 2006/0250895 | A1 * | 11/2006 | Sanchez | 368/29 |
| 2006/0256662 | A1 * | 11/2006 | Martin | 368/10 |
| 2007/0086275 | A1 * | 4/2007 | Robinson et al. | 368/72 |
| 2008/0285389 | A1 * | 11/2008 | Borovsky et al. | 368/10 |

* cited by examiner

*Primary Examiner* — Vit M Miska
(74) *Attorney, Agent, or Firm* — Dale J. Ream

(57) ABSTRACT

A calendar apparatus includes a housing having opposed side rails for holding a calendar therebetween. The calendar apparatus includes a processor and a memory device in data communication with the processor. The apparatus includes a user input device, a microphone, and an audio output positioned in the housing and in data communication with the processor. The processor includes programming for inputting event data using the input device, inputting message data using the microphone, actuating the audio output device to provide alarm or to display message data after occurrence of an event. The calendar apparatus may include a picture holder, a clock, and a calculator.

1 Claim, 5 Drawing Sheets

400

CALENDAR APPARATUS

BACKGROUND OF THE INVENTION

This invention relates generally to calendars and, more particularly to an electronic calendar that audibly announces events that have been prerecorded and that identifies the appropriate frequency of recurring events.

Calendars are frequently used for determining future dates and are frequently used as a reference for remembering events such as appointments, e.g. doctor and business appointments or celebrations, e.g. birthdays or anniversaries. Events that need to be remembered are typically written on the calendar with the assumption that the calendar will be looked at on a frequent enough basis that the recorded events will be noticed and relevant action will be taken. Unfortunately, important events are sometimes forgotten in that the calendar is often not reviewed frequently enough or an event is not noticed due to poor handwriting or because so much information is stored on the calendar.

Various devices have been proposed in the art for electronically recording events on a calendar and for audibly announcing or drawing attention to upcoming events. Although assumably effective for their intended purposes, the existing devices do not hold and display a traditional calendar, allow appointments to be manually recorded thereon in a traditional manner, record messages electronically, identify a date upon which the recorded message is to be played, and associate a frequency with each recorded message to be announced.

Therefore, it would be desirable to have a calendar apparatus that supplies the shortcomings of the existing calendar devices.

SUMMARY OF THE INVENTION

Therefore, a calendar apparatus according to the present invention includes a housing having opposed side rails for holding a calendar therebetween. The calendar apparatus includes a processor and a memory device in data communication with the processor. The apparatus includes a user input device, a microphone, and an audio output positioned in the housing and in data communication with the processor. The processor includes programming inputting event data using the input device, inputting message data using the microphone, actuating the audio output device to provide alarm or display message data after occurrence of an event. The calendar apparatus may include a picture holder, a clock, and a calculator.

Therefore, a general object of this invention is to provide a calendar apparatus that allows messages associated with calendar events to be recorded and audibly replayed.

Another object of this invention is to provide a calendar apparatus, as aforesaid, that holds a traditional calendar and allows messages to be inscribed thereon.

Still another object of this invention is to provide a calendar apparatus, as aforesaid, that enables a user to associate a type or frequency with a recorded message.

Yet another of this invention is to provide a calendar apparatus, as aforesaid, is to display a current time while a user views the calendar.

A further of this invention is to provide a calendar apparatus, as aforesaid, that includes a means for displaying a photograph.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A calendar apparatus will now be described in detail with reference to FIG. 1 through FIG. 5 of the accompanying drawings. More particularly, the calendar apparatus 100 includes a housing 110.

Figure 1:
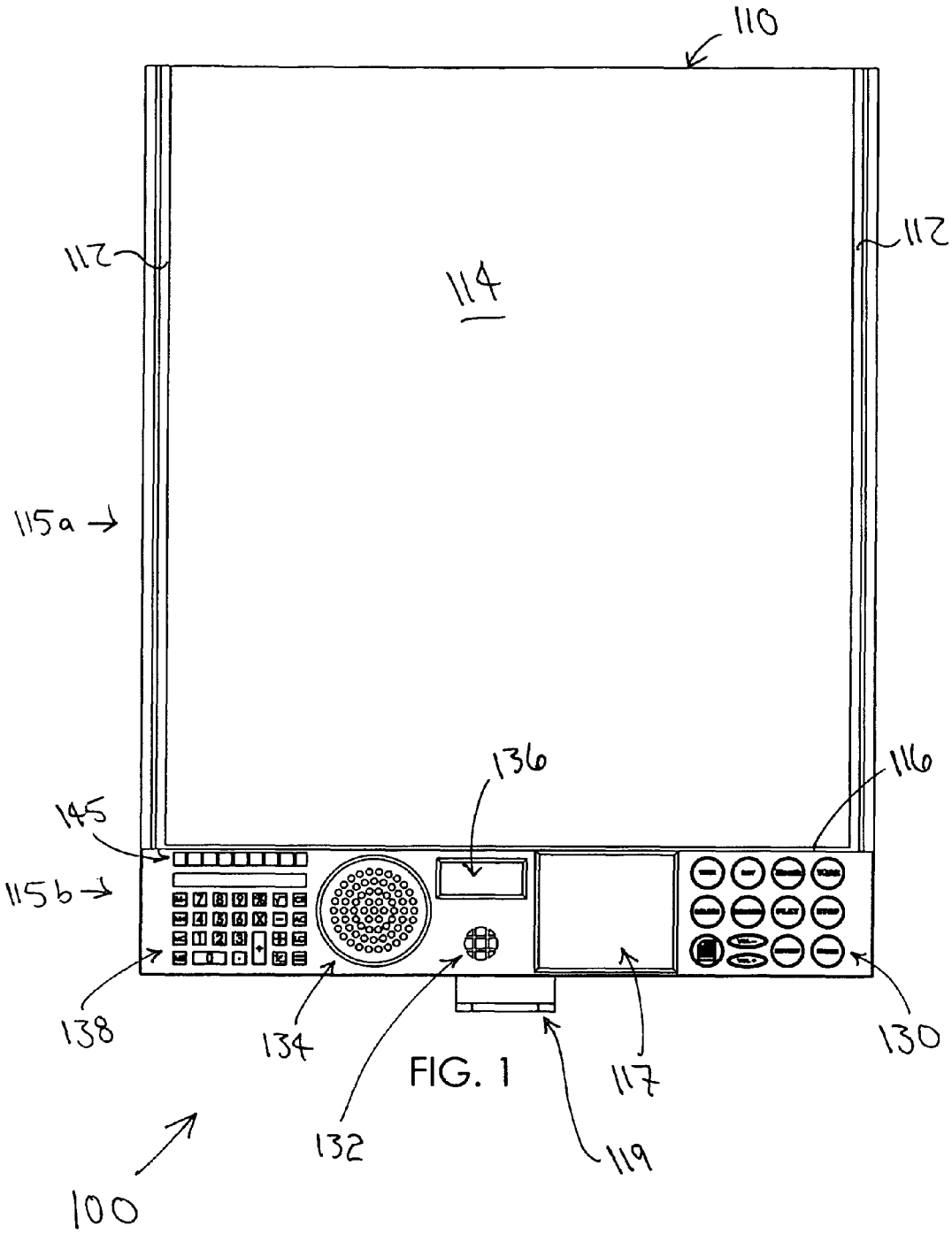
FIG. 1 is a front view of a calendar apparatus according to a preferred embodiment of the present invention.
Figure 3A:
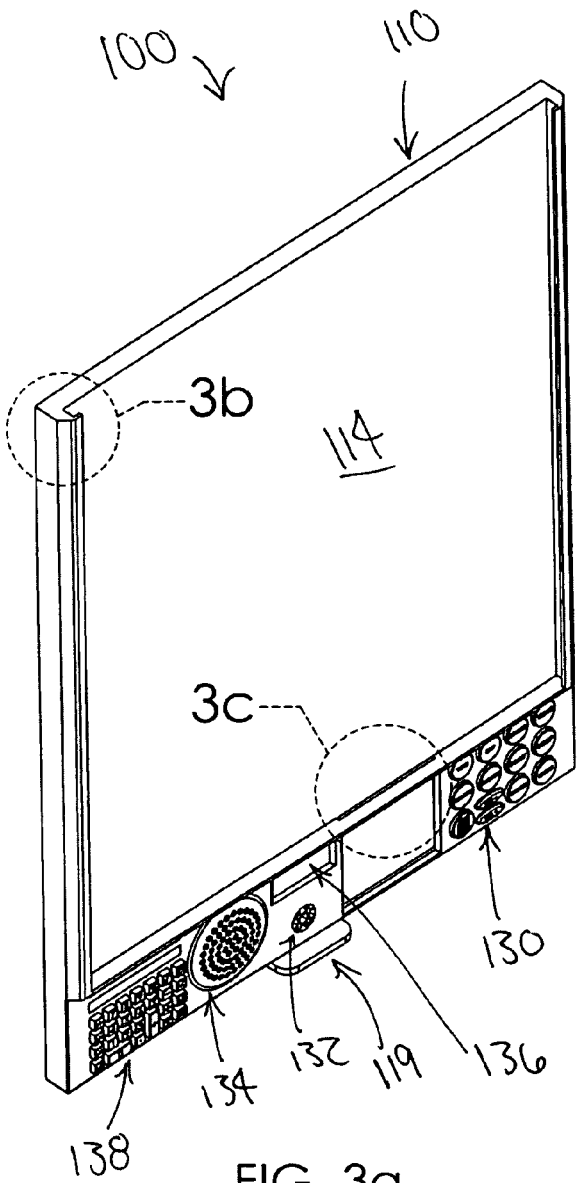
FIG. 3*a* is a perspective view of the calendar apparatus as in FIG. 1.

As shown in FIGS. 1 and 3*a*, the housing 110 includes opposed side rails 112 for holding a calendar therebetween. The housing 110 may include a generally planar face 114, and the opposed side rails 112 may extend in front of the face 114. A floor 116 may extend in front of the face 114 for supporting the calendar thereon. The housing 110 may define a picture opening 117 for displaying a picture, and a slot 118 may allow the picture to be placed in the picture opening 117 (FIG. 3*c*). In one embodiment, the housing 110 has adjacent upper and lower portions 115*a*, 115*b*; the upper portion 115*a* includes the rails 112, the face 114, and the floor 116, and the lower portion 115*b* defines the picture opening 117. A pen holder 119 may be coupled to or defined by the housing 110. It should be understood that the rails 112 may or may not extend continuously and that the pen holder 119 may hold various writing instruments (e.g., markers, pencils, pens, chalk, etc.).

Figure 2A:
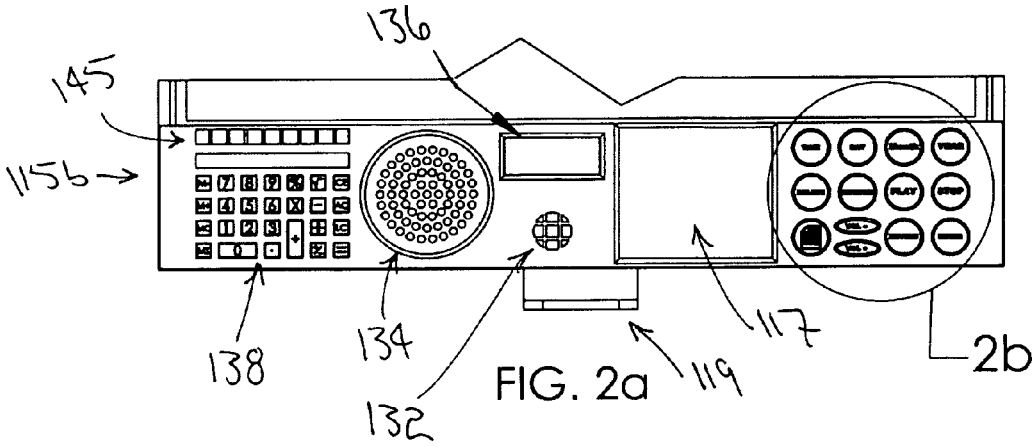
FIG. 2*a* is a fragmentary view showing of a lower portion of the calendar apparatus as in FIG. 1.
Figure 2B:
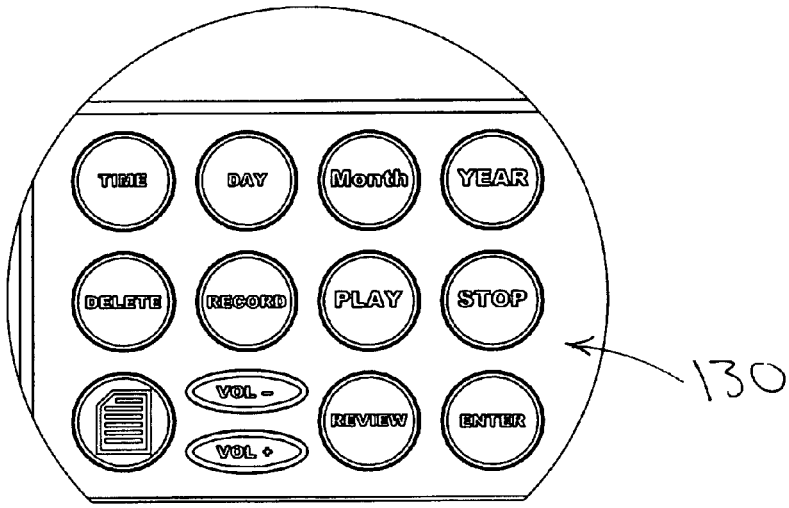
FIG. 2*b* is a isolated view on an enlarged scale taken from a portion of FIG. 2*a;*
Figure 5:
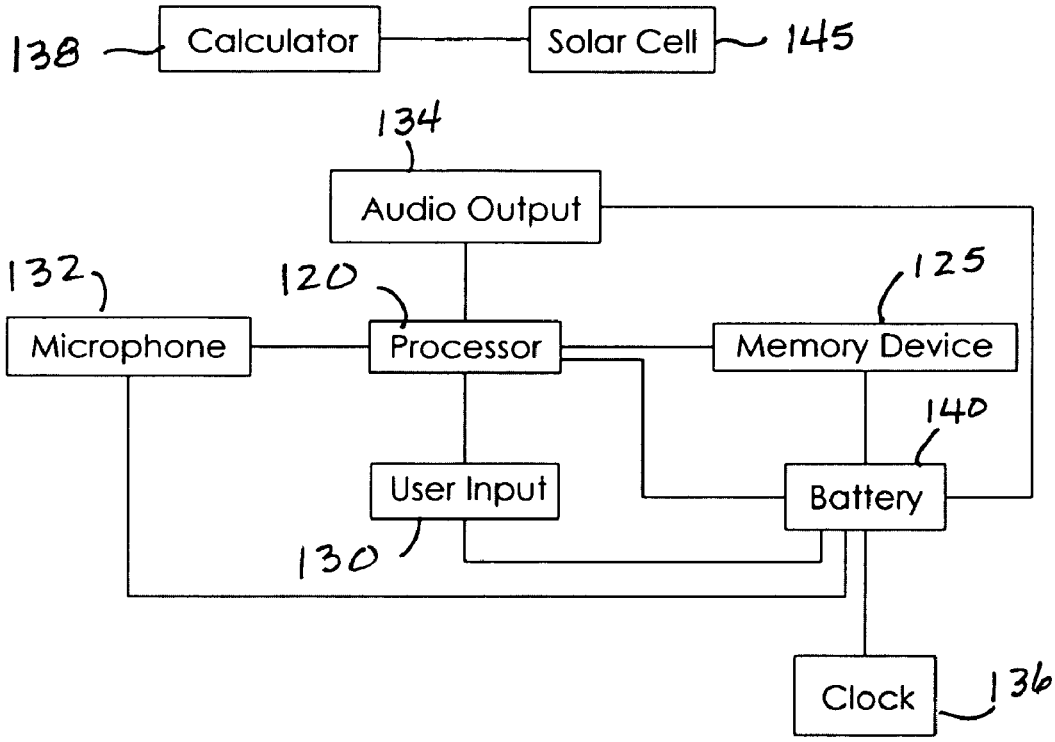
FIG. 5 is a block diagram illustrating the electronic components of the calendar apparatus according to the present invention.
Figure 2A:
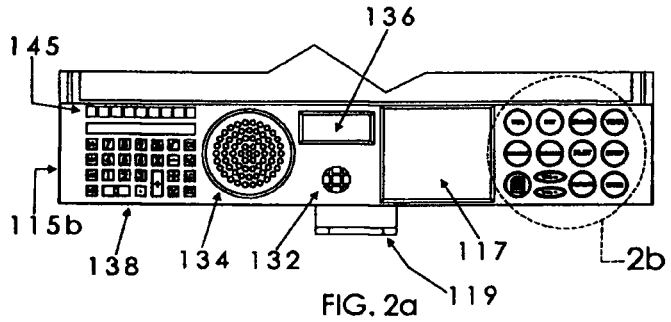
Figure 2B:
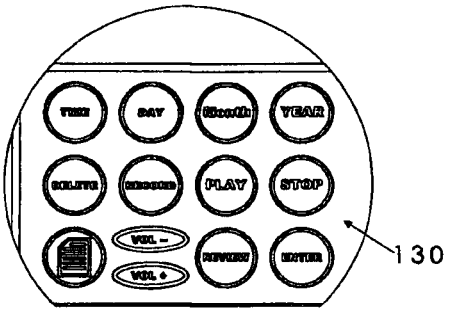
Figure 4:
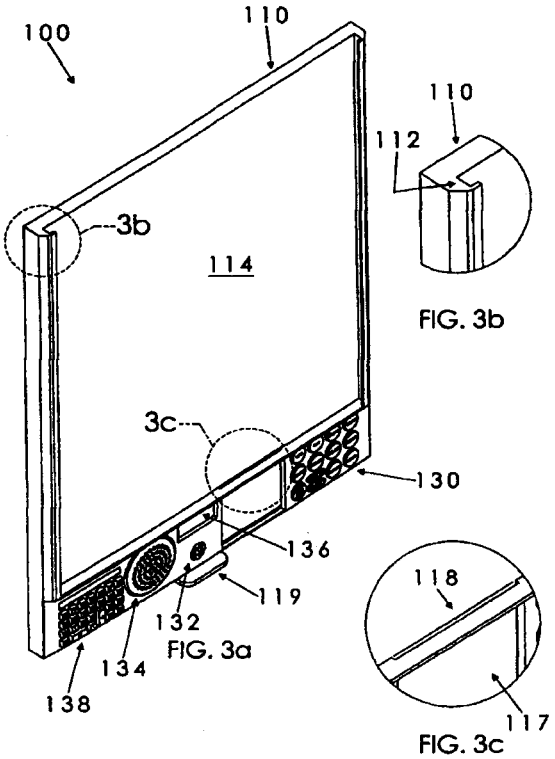
Figure 4:
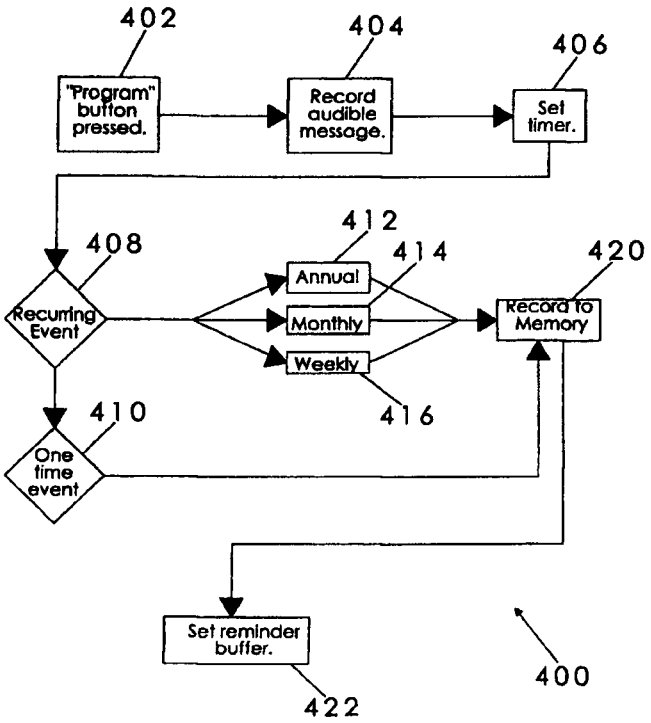
Figure 5:
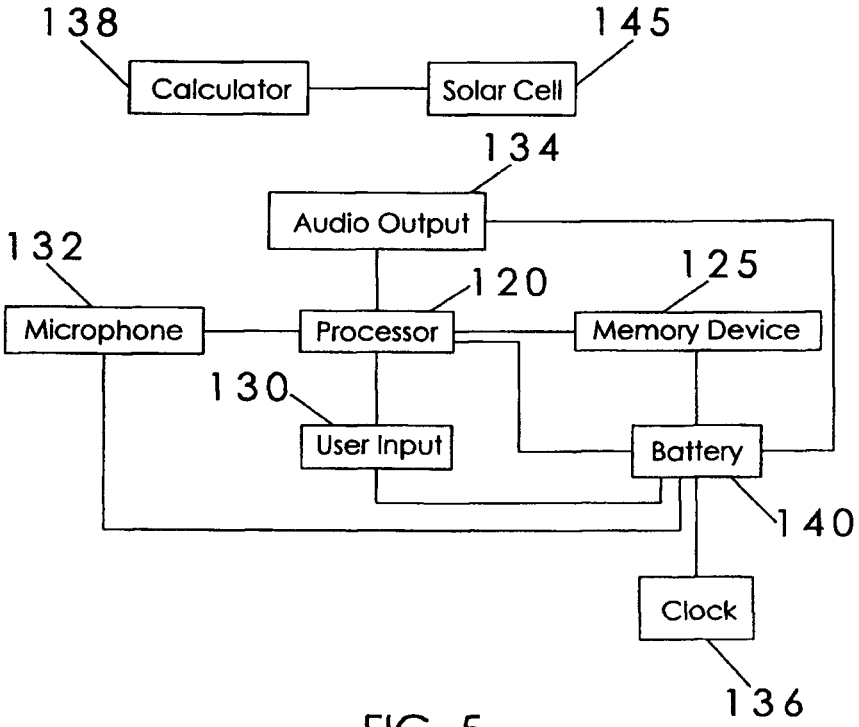

A processor 120 (FIG. 5) is positioned in the housing 110, and a memory device 125 (FIG. 5) is in data communication with the processor 120. A user input device 130 (e.g., a keypad as shown in FIG. 2*b*, a selection knob, etc.), a microphone 132 (FIG. 1), and an audio output device 134 (FIG. 1) are coupled to the housing 110, and the user input device 130, the microphone 132, and the audio output device 134 are in data communication with the processor 120 (FIG. 5). As shown in FIG. 1, the user input device 130, the microphone 132, and the audio output device 134 may be coupled to the housing lower portion 115*b*. As further shown in FIG. 1, a clock 136 may be coupled to the housing 110 (e.g., to the housing lower portion 115*b*) to display time of day, and/or a calculator 138 may be coupled to the housing 110 (e.g., to the housing lower portion 115*b*).

Means for powering the processor 120, the memory device 125, the input device 130, the microphone 132, the output device 134, the clock 136, and the calculator 138 may be included. For example, as shown in FIG. 5, the processor 120, the memory device 125, the input device 130, the microphone 132, the output device 134, and the clock 136 may be powered by one or more battery 140, and the calculator 138 may be powered by a solar cell 145. It should be understood that the calculator 138 may alternately be powered by a battery, that other devices may be powered by one or more solar cell, and/or that devices may be powered by alternating current from a grid power supply or from any other appropriate source.

Figure 4:
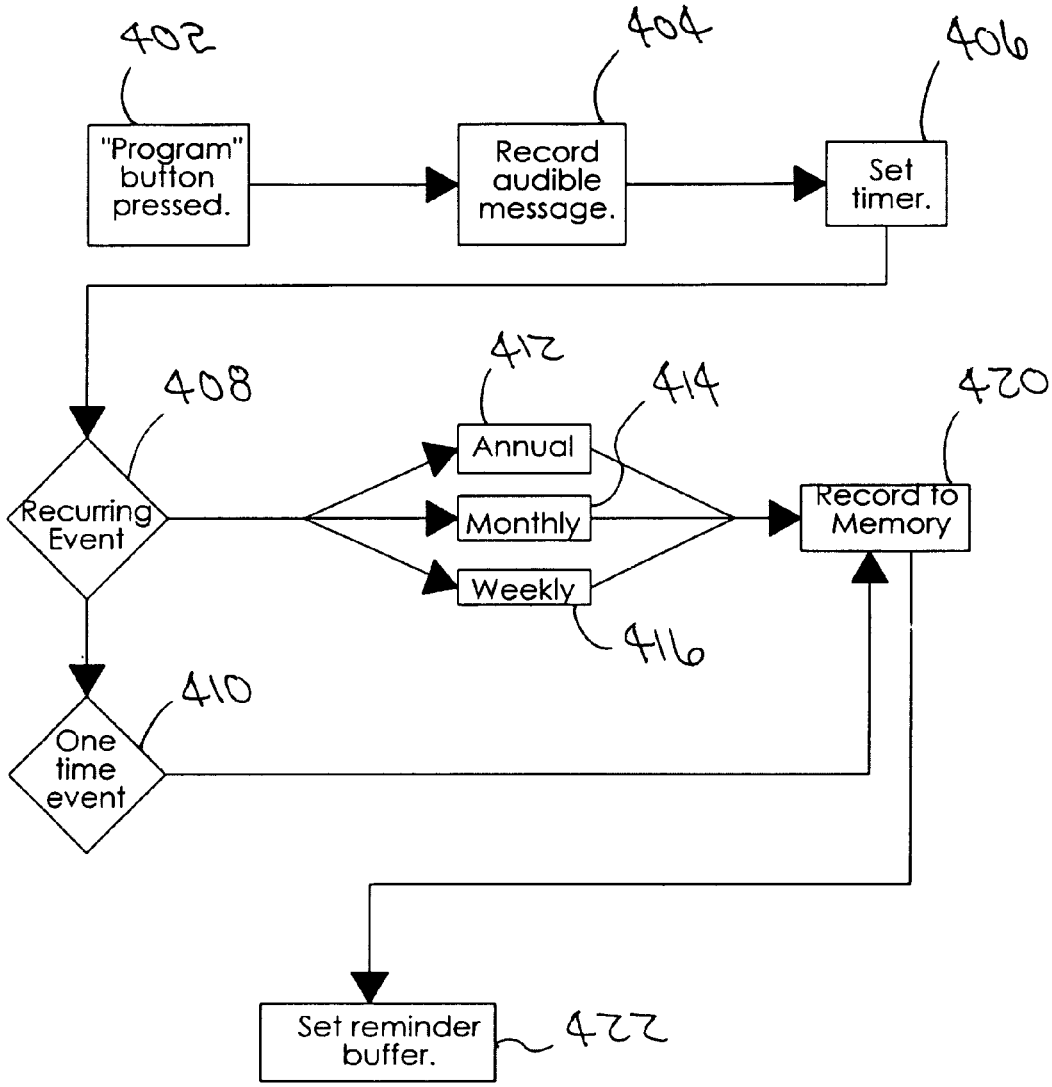
FIG. 4 is a flowchart illustrating the logic performed by the processor.

The processor 120 may include various programming to accomplish desired functions. Exemplary functions are set forth in flowchart 400 (FIG. 4). For example, upon a user actuating the processor 120 through the input device 130 in step 402, the user may provide message data (i.e., a message associated with an event) to the microphone 132 at step 404. The processor 120 may include programming to input the message data from the microphone 132 to the memory device 125 (see step 420).

The user may provide event data (e.g., date, time, and name of event) to the input device 130 at step 406, and the processor 120 may include programming to input the event data from the input device 130 to the memory device 125 (see step 420). Notably, many steps of the flowchart 400 may be rearranged, and order of steps is not important unless one step depends upon the happening of another.

At step 408, the user determines if the event is recurring. If not, the user may indicate such through the input device 130 at step 410. If so, the user may input recurring data into the input device 130 at steps 412, 414, and 416; for example, the user may indicate that the event recurs every year (step 412), every month (step 414), weekly (step 416), etc. The processor 120 may include programming to project event data based on the event data (e.g., date, time, and name of the event) and the recurring data and then input the projected event data (e.g., date, time, name of projected event) to the memory device 125 (see step 420).

At step 422, the user may determine the desired frequency of an alarm and/or an amount of time before the event or projected event that an alarm is desired. The processor 120 may include programming to input this data from the input device 130 to the memory device 125.

Programming may also be in the processor 120 to actuate the audio output device 134 to provide an alarm upon occurrence of the event and occurrence of the projected event, and programming in the processor 120 may actuate the audio output device 134 to audibly display the message data stored in the memory device 125 after occurrence of the event and occurrence of the projected event. If desired frequency data or an amount of time before the event or projected event is input (see step 422), the processor 120 may actuate the audio output device 134 in accordance with those parameters. The message data may automatically be audibly displayed (i.e. announced or annunciated) after occurrence of the event or projected event, or the user may have to utilize the input device 130 to have the message data audibly displayed.

In use, a calendar may be held between the rails 112, a picture may be placed in the picture opening 117 through the slot 118, a writing utensil may be held in the pen holder 119, and the clock 136 and calculator 138 may be used in a traditional manner.

Due to the components and programming described above, a user may be audibly alerted to events as desired. Returning to FIG. 4, the user may, for example, input message data noting an acquaintance's birthday (e.g., "John's birthday") at step 404 using the microphone 132, and the processor 120 may input the message data to the memory device 125. At step 406, the user may input the date of the birthday, the time that an alarm is desired, and a name to identify the acquaintance's birthday (e.g., January 1; 8:00 a.m.; "John's birthday"). At step 408, the user may indicate (using input 130) that the event is recurring, and the user may indicate (using input 130) that the event recurs yearly at step 412. The processor 120 may project future birthdays based on the January 1 date and the fact that the event recurs yearly and then input data regarding the projected future birthdays (e.g., date, time, name of event) to the memory device 125 (see step 420). The processor 120 may then actuate the output device 134 to sound an alarm on each January 1 at 8:00 a.m., and the processor 120 may actuate the output device 134 to audibly present the recorded message data (e.g., "John's birthday"). It should be appreciated by this example that recurring events do not need to be repeatedly input or reset but rather are automatically set to trigger an alarm or audible message every time that they occur in the future.

In another example referring to FIG. 4, the user may input message data that includes notes for a meeting at step 404 using the microphone 132, and the processor 120 may input the message data to the memory device 125. At step 406, the user may input the date of the meeting, the time that an alarm is desired, and a name to identify the event (e.g., Jan. 1, 2010; 1:00 p.m.; "company meeting"). At step 410, the user may indicate (using input 130) that the event is a one time event using the input device 130. The user may indicate the desired frequency of the alarm (e.g., thirty minutes) and an amount of time before the event that an alarm is desired (e.g., two hours). The processor 120 may then actuate the output device 134 to sound an alarm on Jan. 1, 2010 at 11:00 a.m., and the processor 120 may actuate the output device 134 to audibly present the recorded message data (i.e., the notes for the meeting input at step 404). Unless the input device 130 is used to turn off the alarm, the processor 120 may actuate the alarm every thirty minutes from 11:00 a.m. on Jan. 1, 2010 until a predetermined maximum amount of time passes.

It is understood that while certain forms of this invention have been illustrated and described, it is not limited thereto except insofar as such limitations are included in the following claims and allowable functional equivalents thereof.

The invention claimed is:

1. A calendar apparatus, comprising:

a housing having a lower portion and an upper portion upwardly adjacent said lower portion, said upper portion having a generally planar face, opposed side rails extending in front of said face configured to hold a calendar therebetween, and a floor extending in front of said face configured to support the calendar thereon;

wherein said lower portion of said housing defines a picture opening for displaying a picture;

wherein said floor of said upper portion defines a slot configured to selectively receive a picture into said picture opening;

a calculator coupled to said housing lower portion;

means for powering said calculator;

a pen holder defined by or coupled to said lower portion of said housing;

a processor positioned in said housing;

a memory device in data communication with said processor;

a user input device coupled to said housing lower portion and being in data communication with said processor;

a microphone coupled to said housing lower portion and being in data communication with said processor;

an audio output device coupled to said housing lower portion and being in data communication with said processor;

means for powering said processor, said memory device, said input device, said microphone, and said output device;

programming in said processor to:

input event data from said input device to said memory device, said event data being associated with an event;

input message data from said microphone to said memory device, said message data being associated with said event;

actuate said audio output device to provide an alarm upon occurrence of said event; and actuate said audio output device to audibly display said message data after occurrence of said event;

project event data and input said projected event data to said memory device, said projected event data being associated with at least one projected event, said projected event data being related to said event and recurring data from said input device;

actuate said audio output device to provide an alarm upon occurrence of said at least one projected event;

actuate said audio output device to audibly display said message data after occurrence of said at least one projected event;

actuate said audio output device to provide an alarm a predetermined amount of time before occurrence of said event; and wherein said user input device includes a keypad.

* * * * *

UNITED STATES PATENT AND TRADEMARK OFFICE

CERTIFICATE OF CORRECTION

PATENT NO. : 7,986,590 B2
APPLICATION NO. : 12/110835
DATED : July 26, 2011
INVENTOR(S) : Angela Hansen It is certified that error appears in the above-identified patent and that said Letters Patent is hereby corrected as shown below:

Title Page, delete Title Page, and replace with new Title Page. (Attached)

On drawing Sheet 1 of 5, replace the informal drawing of Fig 1 with the formal drawing of Fig 1.

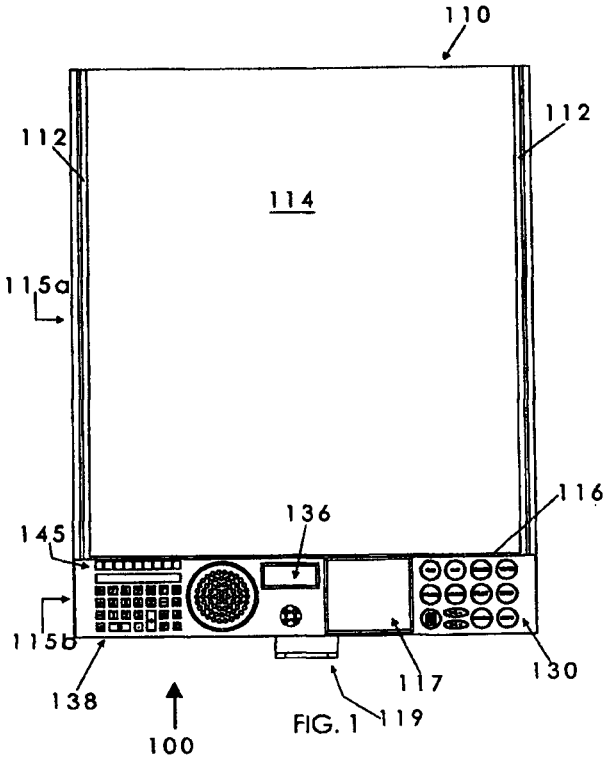

FIG. 1

Signed and Sealed this
Fourth Day of October, 2011

David J. Kappos

David J. Kappos
*Director of the United States Patent and Trademark Office*

On drawing Sheet 2 of 5, replace the informal drawing of Fig 2 with the formal drawing of Fig 2.

Figure 3B:
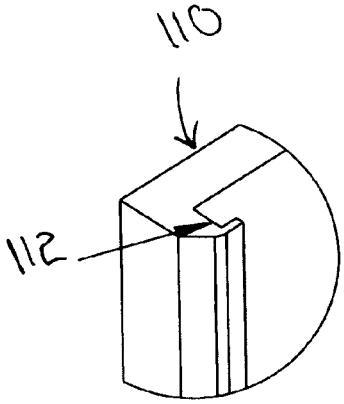
FIG. 3*b* is an isolated view on an enlarged scale taken from a portion of FIG. 3*a;*
Figure 3C:
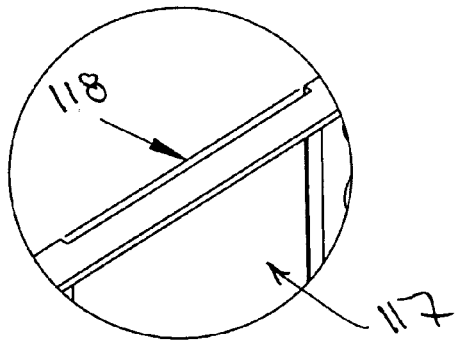
FIG. 3*c* is an isolated view on an enlarged scale taken from another portion of FIG. 3*a;*

On drawing Sheet 3 of 5, replace the informal drawing of Fig 3 with the formal drawing of Fig 3.

On drawing Sheet 2 of 5, replace the informal drawing of Fig 2 with the formal drawing of Fig 2.

On drawing Sheet 2 of 5, replace the informal drawing of Fig 2 with the formal drawing of Fig 2.

(12) United States Patent
Hansen

(10) Patent No.: US 7,986,590 B2
(45) Date of Patent: Jul. 26, 2011

(54) CALENDAR APPARATUS

(76) Inventor: Angela Hansen, Dubuque, IA (US)

( * ) Notice: Subject to any disclaimer, the term of this patent is extended or adjusted under 35 U.S.C. 154(b) by 534 days.

(21) Appl. No.: 12/110,835

(22) Filed: Apr. 28, 2008

(65) Prior Publication Data

US 2009/0268564 A1 Oct. 29, 2009

(51) Int. Cl.

| | |
|---|---|
| ***G04B 47/00*** | (2006.01) |
| ***G04B 19/24*** | (2006.01) |
| ***G04C 21/00*** | (2006.01) |
| ***G04C 23/02*** | (2006.01) |
| ***G09D 3/02*** | (2006.01) |

(52) U.S. Cl. ..... 368/10; 368/29; 368/73; 368/88; 368/278; 40/122

(58) Field of Classification Search ..... 368/10, 368/28–30, 41, 63, 72–74, 250, 88, 76, 278; 40/107, 122; 705/8, 9

See application file for complete search history.

(56) References Cited

U.S. PATENT DOCUMENTS

| | | | | | |
|---|---|---|---|---|---|
| 2,845,732 | A | * | 8/1958 | Nichols | 40/726 |
| 2,892,275 | A | * | 6/1959 | Woofter | 40/122 |
| 4,276,703 | A | * | 7/1981 | Brindley | 40/121 |
| 4,302,752 | A | | 11/1981 | Weitzler | |
| 4,708,490 | A | * | 11/1987 | Arber | 368/28 |
| 5,199,009 | A | * | 3/1993 | Svast | 368/240 |
| 5,708,627 | A | | 1/1998 | Gormley | |
| 5,754,629 | A | * | 5/1998 | Kunimori et al. | 379/88.13 |
| 5,999,492 | A | * | 12/1999 | Teixeira | 368/10 |
| 6,069,848 | A | * | 5/2000 | McDonald et al. | 368/107 |
| 6,574,894 | B1 | * | 6/2003 | Hamilton | 40/107 |
| 7,200,071 | B2 | * | 4/2007 | Brophy | 368/28 |
| 7,480,212 | B1 | * | 1/2009 | DuBreuil | 368/30 |
| 2006/0250895 | A1 | * | 11/2006 | Sanchez | 368/29 |
| 2006/0256662 | A1 | * | 11/2006 | Martin | 368/10 |
| 2007/0086275 | A1 | * | 4/2007 | Robinson et al. | 368/72 |
| 2008/0285389 | A1 | * | 11/2008 | Borovsky et al. | 368/10 |

* cited by examiner

*Primary Examiner* — Vit M Miska
(74) *Attorney, Agent, or Firm* — Dale J. Ream

(57) ABSTRACT

A calendar apparatus includes a housing having opposed side rails for holding a calendar therebetween. The calendar apparatus includes a processor and a memory device in data communication with the processor. The apparatus includes a user input device, a microphone, and an audio output positioned in the housing and in data communication with the processor. The processor includes programming for inputting event data using the input device, inputting message data using the microphone, actuating the audio output device to provide alarm or to display message data after occurrence of an event. The calendar apparatus may include a picture holder, a clock, and a calculator.

1 Claim, 5 Drawing Sheets

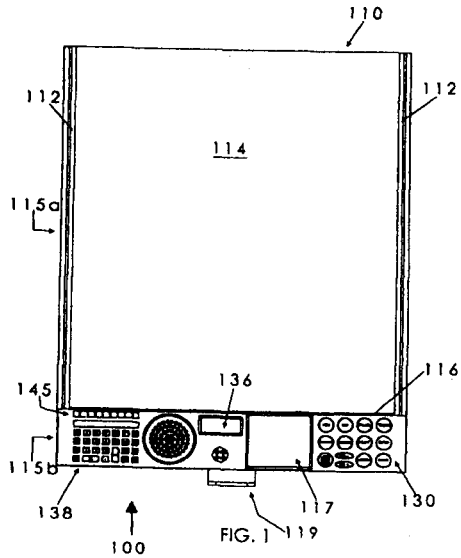

FIG. 1